United States Patent [19]

Nahas

[11] Patent Number: 5,033,985

[45] Date of Patent: Jul. 23, 1991

[54] DIET AID DOLLS

[76] Inventor: Gregory H. Nahas, 43 Elm St., Foxborough, Mass. 02035

[21] Appl. No.: 551,154

[22] Filed: Jul. 11, 1990

[51] Int. Cl.[5] ..... A63H 3/06

[52] U.S. Cl. ..... 446/224; 446/320; 446/226

[58] Field of Search ..... 446/224, 221, 223, 226, 446/220, 296, 331, 472, 320, 321, 331, 337, 365, 183, 198, 199

[56] References Cited

U.S. PATENT DOCUMENTS

| | | | |
|---|---|---|---|
| 494,410 | 3/1893 | Carpenter | 446/226 X |
| 1,461,193 | 7/1923 | Larsen | 446/224 |
| 1,464,107 | 8/1923 | Pederson | 446/224 X |
| 1,634,189 | 6/1927 | Henry | 446/226 |
| 2,912,791 | 11/1959 | Cohen | 446/220 X |
| 4,226,902 | 10/1980 | Webb | 446/220 X |
| 4,259,805 | 4/1981 | Hornsby | 446/198 |

*Primary Examiner*—Danton D. DeMille

*Attorney, Agent, or Firm*—Irving M. Kriegsman; Edward M. Kriegsman

[57] ABSTRACT

The devices are comprised of the figure of a male pig and a female pig with a written message at the base of the dolls.

The dolls are attached to a refrigerator by magnetic strips on their backside. When a person presses the nose of the pig doll, a portion of the doll is inflated to a greater size. This expansion of the pig doll is to visually remind people that their own bodys will expand in size when they continually over-eat.

7 Claims, 4 Drawing Sheets

DIET AID DOLLS

BRIEF SUMMARY OF THE INVENTION

The diet aid dolls are essentially devices that can aid the average person by helping them not to over eat. The diet aid dolls give a person a visual aid to help them not to over eat. This is accomplished when the diet aid dolls are attached to the refrigerator door. When a person sees the doll on the refrigerator door and follows the instructions at the base of the doll, the person inflates a portion of the body of the doll by pushing the nose of the doll. When the person sees that the body of the doll has expanded, this reminds the person that his or her own body can expand by over eating and look unappealling.

BRIEF DESCRIPTION OF THE DRAWINGS

FIG. 3 shows a cross-sectional view of the male pig doll when the nose is not pushed in.

FIG. 5 shows a cross-sectional view of the female pig doll when the nose is not pushed in.

DETAILED DESCRIPTION

Figure 1:
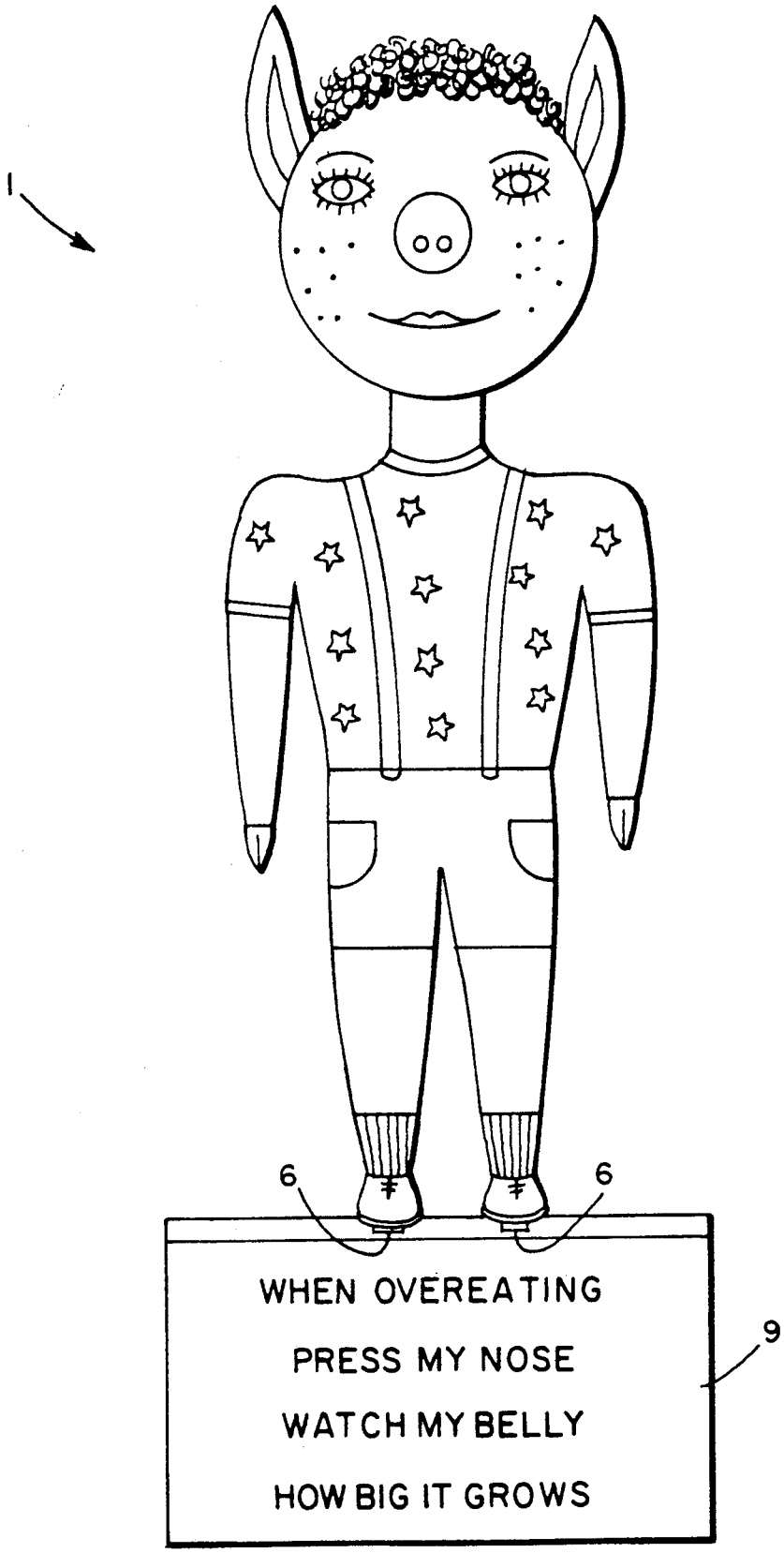
FIG. 1 shows the assembled view of the male pig doll with the written message at the base of the doll.

Referring now to the drawings, there is shown in FIG. 1 the male pig doll dressed in clothing resembling a man, the male pig doll being represented generally by reference numeral 1. The male pig doll has the basic physical build of a man in good physical condition. There is a small sign 9 at the base of the male pig doll. This is to instruct the person viewing the doll to press the nose of the male pig doll when that person is over eating.

Figure 2:
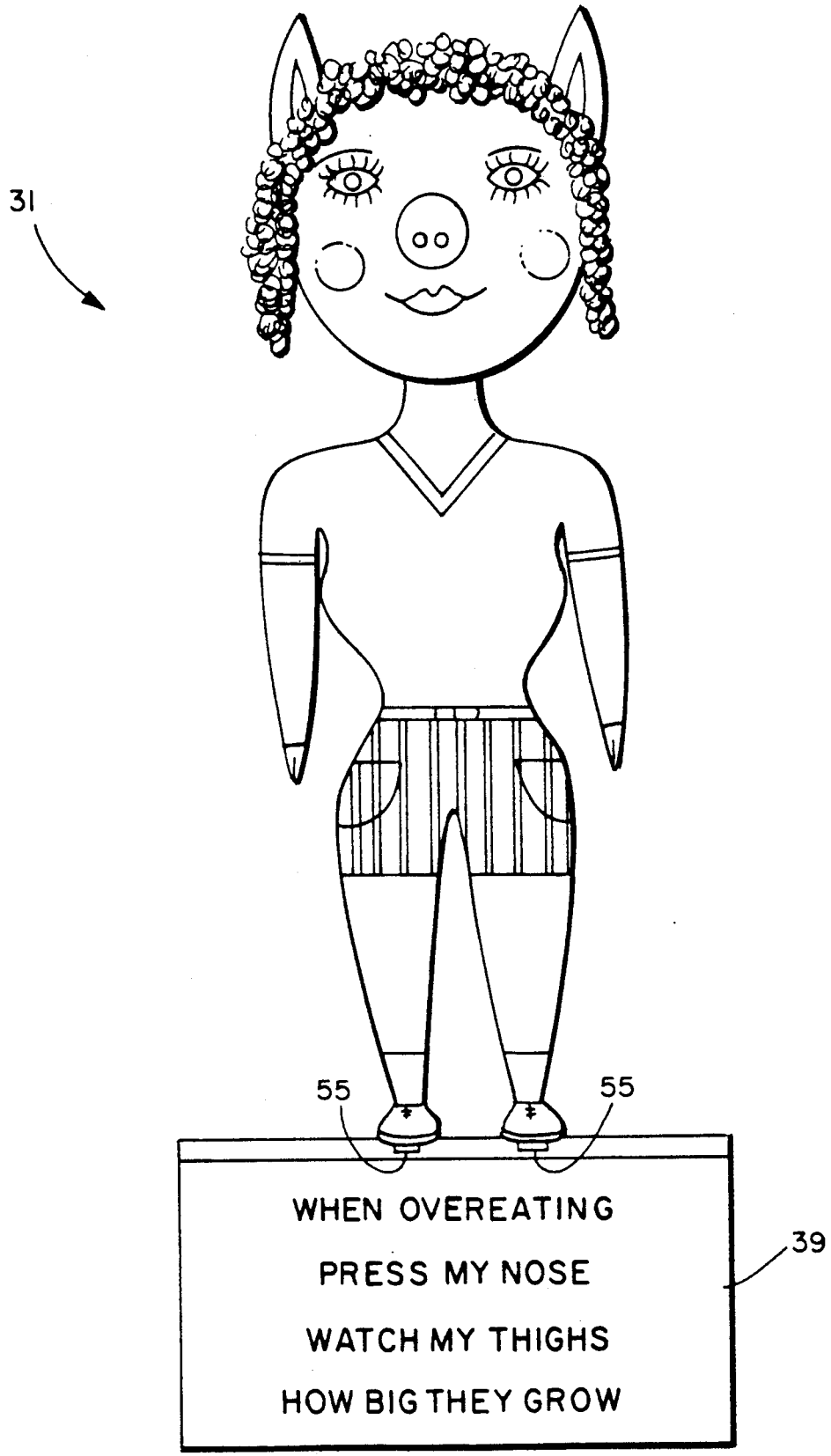
FIG. 2 shows the assembled view of the female pig doll with the written message at the base of the doll.

FIG. 2 shows the appearance of the female pig doll, the female pig doll being represented generally by reference numeral 31. The doll is shown in clothing resembling that of a woman. The shape of the female pig doll resembles the shape of a woman. There is a small sign 39 at the base of the female pig doll. This is to instruct the person viewing the doll to press the nose of the female pig doll when that person is over eating.

Both the male and female pig dolls are constructed of a flexible rubber material that can be expanded or stretched.

Figure 3:
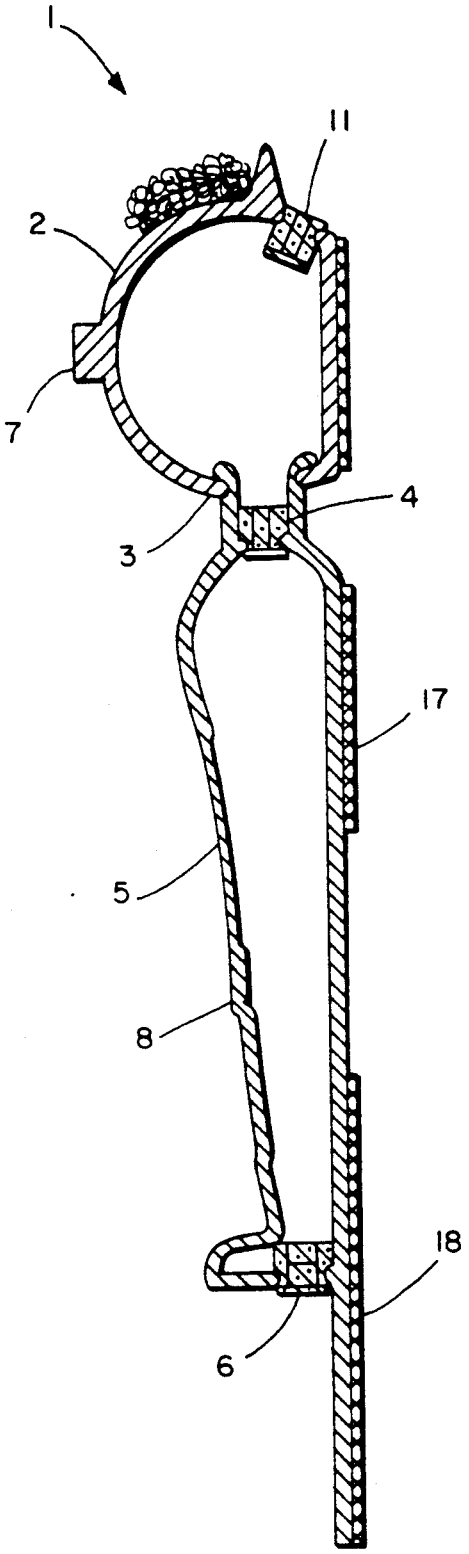

FIG. 3 shows a cross-sectional view of the male pig doll. The doll is made up of a head portion and a separate body portion. The head, reference numeral 2, joins the body, reference numeral 8, at the joint shown by reference numeral 3, by a tongue in grove construction, which provides an air tight joint. Reference numeral 7 is the nose of the male pig doll. Located on the top of the head is a one-way flow air valve, reference numeral 11, which allows air to only enter the head portion of the doll and not to exit it.

Reference numeral 4 is another one way flow air valve which only allows air to pass from inside the head cavity into the body cavity.

Reference numeral 5 shows the cross-sectional wall thickness of the abdomen area of the male doll to be much thinner than the cross-sectional wall thickness of the remainder of body 8. This is to allow greater expansion of this region, when the body cavity has greater than atmospheric air pressure in it. Reference numeral 6 shows the air pressure relief valve which allows destructive air pressure to be released from the body cavity.

Figure 4:
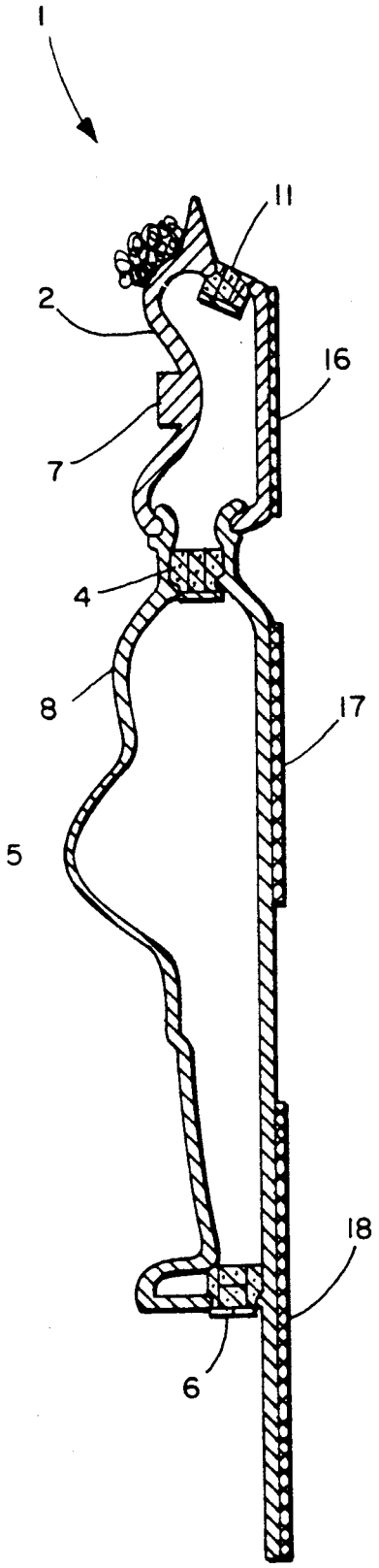
FIG. 4 shows a cross-sectional view of the male pig doll when the nose is pushed in and the stomach portion is expanded.

FIG. 4 shows a cross-sectional view of the male pig doll the nose, reference numeral 7, having been pushed in by a person. The head portion of the doll, reference numeral 2, is actually a small air pump. When the nose is pushed in, the entire head of the doll collapses. This causes air to be forced from the head cavity through the one-way air valve, reference numeral 4, and into the body cavity of the male pig doll. Air will not travel through the one-way air valve on top of the head, reference numeral 11, to the outside, because this valve only allows air to travel from the outside to the inside of the head. As the air is pushed into the body cavity of the doll, the stomach portion of the doll begins to inflate first, reference numeral 5. When the person takes his finger off of the nose of the doll, the head portion, reference numeral 2, will expand back into its normal shape by allowing air to enter the head through the one way air valve on top of the doll's head. Air will not travel from the body cavity into the head portion because, reference numeral 4, is a one way air valve.

After repeated compressions of the head, the stomach area of the body cavity has now inflated to noticeable proportions. This will now convey the visual message to the person observing, who has been over eating, that the present condition of the pig doll, is how they will look also.

When the air pressure in the doll's body cavity reaches a destructive limit to the doll, a pressure relief valve, reference numeral 6, will open and allow the air pressure to be released. This relief valve will only have to be reset, by pushing it back in, to allow this sequence to repeat itself.

The male pig doll has magnetic tape, reference numerals 16, 17, and 18, attached to the back side of the doll, to allow this doll to be magnetically attached to the door of any refrigerator, that is made of metal.

Figure 5:
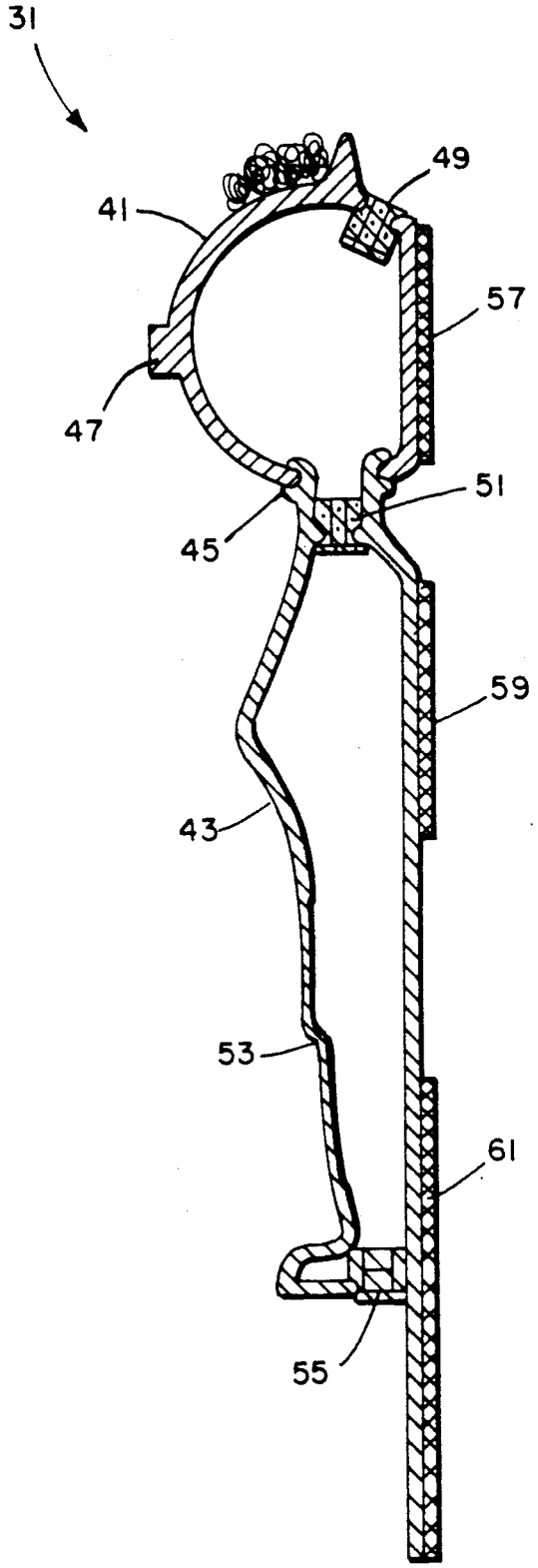

FIG. 5 shows a cross-sectional view of the female pig doll. The doll is made up of a head portion and a separate body portion. The head, reference numeral 41, joins the body, reference numeral 43, by a tongue in groove construction 45 which provides an air tight joint.

Reference numeral 47 is the nose of the female pig doll. Located on top of the head is a one-way air valve, reference numeral 49, which only allows air to enter the head portion of the doll.

Reference numeral 51 is another one-way air valve which only allows air to pass from inside the head cavity into the body cavity.

Reference numeral 53 shows the cross-sectional wall thickness of the thigh area of the leg to be much thinner than the rest of the body wall thickness. This is to allow greater expansion of this region, when the body cavity has greater than atmospheric air pressure in it. Reference numeral 55, shows the air pressure relief valve which allows destructive air pressures to be released from the body cavity.

Reference numerals 57, 59 and 61 show the magnetic tape on the back side of the doll, to allow the female pig doll to be attached magnetically to a refrigerator door.

Figure 6:
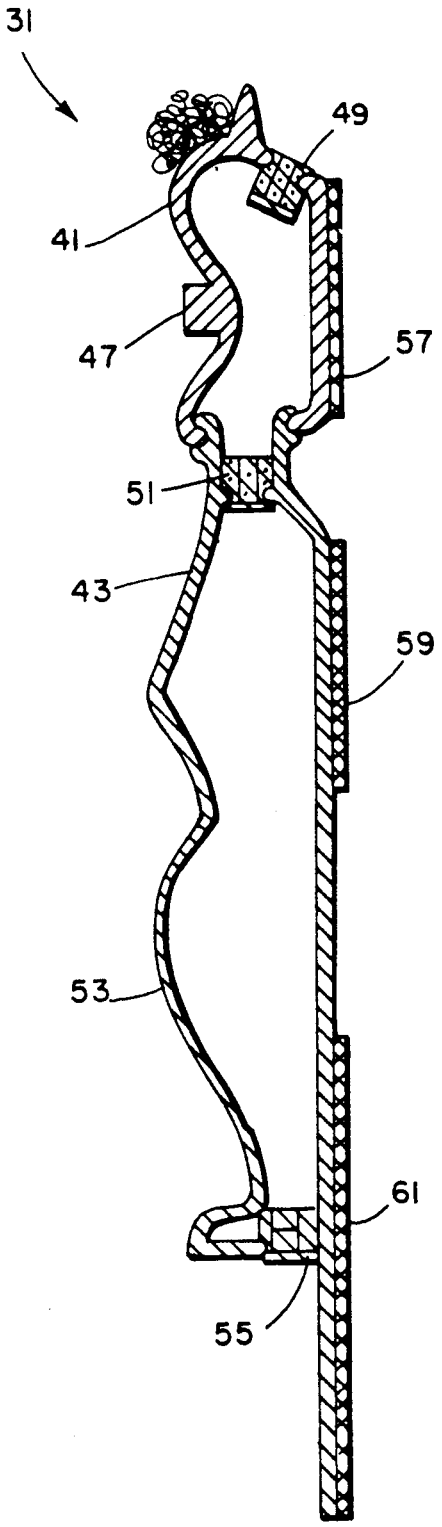
FIG. 6 shows a cross-sectional view of the female pig doll when the nose is pushed in and the thigh portion of the doll is expanded.

FIG. 6 shows a cross-sectional view of the female pig doll the nose, reference numeral 47, having been pushed in by a person. The head, reference numeral 41, portion of the doll is actually a small air pump. When the nose is pushed, the entire head of the doll collapses. This causes air to be forced from the head cavity, through the one-way air valve, reference numeral 51, and into the body cavity of the female pig doll. Air will not travel through the one-way air valve on top of the head, reference numeral 49, to the outside, because this valve only allows air to travel from the outside to the inside of the head. As the air is pushed into the body cavity of the doll, the thigh portion of the leg of the female pig doll begins to inflate first, reference numeral 53.

When the person takes his finger off of the nose of the doll, the head portion, reference numeral 41, will expand back into its normal shape by allowing air to enter the head cavity through the one-way air valve on top of the doll's head, reference numeral 49. Air will not travel from the body cavity into the head cavity because of the one-way air valve, reference numeral 51.

After repeated compressions of the head the upper leg area of the body cavity has now inflated to noticeable proportions. This will now convey the visual message to the person who has been over eating, that the present condition of the pig doll is how they will look also.

Before the air pressure in the body cavity reaches a destructive limit to the doll, a pressure relief valve, reference numeral 55, will open and allow the air pressure to be released. This relief valve will only have to be reset by pushing it back in, to allow this sequence to repeat itself.

I claim:

1. A manually operable amusement device comprising:

a toy figure in the form of a doll, said doll having;

a head portion and a body portion, each of said head portion and said body portion having a hollow flexible chamber formed therein, said body portion having varying wall thicknesses to provide greater expansion of certain body parts when the hollow chamber of said body portion is inflated with air;

a first one-way check valve for allowing air to flow into the hollow chamber of said head portion;

a second one-way check valve for allowing air to flow from the hollow chamber of said head portion into the hollow chamber of said body portion; and a relief valve for releasing from the hollow chamber of said body portion air contained at destructive air pressures.

2. The manually operable amusement device as claimed in claim 1 wherein said relief valve is constructed to open automatically when the air pressure within the hollow chamber of said body portion reaches a level which is destructive to the doll.

3. The manually operable amusement device as claimed in claim 1 wherein the wall thickness of said body portion is thinnest in the stomach area.

4. The manually operable amusement device as claimed in claim 1 wherein the wall thickness of said body portion is thinnest in the thigh area.

5. The manually operable amusement device as claimed in claim 1 wherein said doll further has a sign located at the base thereof.

6. The manually operable amusement device as claimed in claim 1 further comprising a magnetic tape mounted on said doll for magnetic attachment to a suitable metallic surface.

7. The manually operable amusement device as claimed in claim 1 wherein said second one-way check valve is disposed between said chambers of said head portion and said body portion.

* * * * *